US008336632B2

(12) United States Patent
Morrow et al.

(10) Patent No.: US 8,336,632 B2
(45) Date of Patent: Dec. 25, 2012

(54) SYSTEM AND METHOD FOR DIRECT DRIVE PUMP

(75) Inventors: William Bruce Morrow, Santa Barbara, CA (US); Raymond Witten, Owasso, OK (US)

(73) Assignee: Harrier Technologies, Inc., Greenwich, CT (US)

( * ) Notice: Subject to any disclaimer, the term of this patent is extended or adjusted under 35 U.S.C. 154(b) by 168 days.

(21) Appl. No.: 12/552,806

(22) Filed: Sep. 2, 2009

(65) Prior Publication Data

US 2011/0048738 A1 Mar. 3, 2011

(51) Int. Cl.
*E21B 19/16* (2006.01)
*E21B 43/00* (2006.01)

(52) U.S. Cl. ..... 166/380; 166/105; 417/360; 417/423.3

(58) Field of Classification Search ..... 166/380, 166/382, 68, 105; 417/360, 423.3, 424.1
See application file for complete search history.

(56) References Cited

U.S. PATENT DOCUMENTS 2,171,171 A * 8/1939 Brauer ..... 166/68
4,957,161 A * 9/1990 Cholet et al. ..... 166/105
5,069,284 A 12/1991 Gray
5,309,998 A 5/1994 Rivas et al.
5,960,886 A 10/1999 Morrow
6,413,065 B1 7/2002 Dass
6,454,010 B1 9/2002 Thomas et al.
6,523,624 B1 2/2003 Cousins et al.
6,729,391 B2 * 5/2004 Hill et al. ..... 166/68.5
6,796,390 B1 9/2004 Bakker
6,966,366 B2 11/2005 Rogers, Jr.
2006/0000605 A1 * 1/2006 Jordan et al. ..... 166/255.1
2010/0166578 A1 * 7/2010 Watson ..... 417/423.3

OTHER PUBLICATIONS

PCT International Search Report for PCT/US2010/045377, dated Oct. 8, 2010.

* cited by examiner

*Primary Examiner* — Daniel P Stephenson
(74) *Attorney, Agent, or Firm* — Kenyon & Kenyon LLP

(57) ABSTRACT

A method and a system are provided for a direct drive pump for use in pumping fluids and/or quasi-fluids from one location to another. In the direct drive pump, bearings or bushings are optimally spaced, taking into account various operational considerations such as load, path, pressure, and tension. Further, bearings or bushings are coupled to the drive string, thus assisting in more efficient installation and de-installation. The bearings or bushings are not fixed to the production casing or drive tube. In embodiments, the drive tube can be vented, and the production fluid can be used as a lubricant for the system bearings.

15 Claims, 11 Drawing Sheets

DDP Bottom Hole Assembly
with drive tube

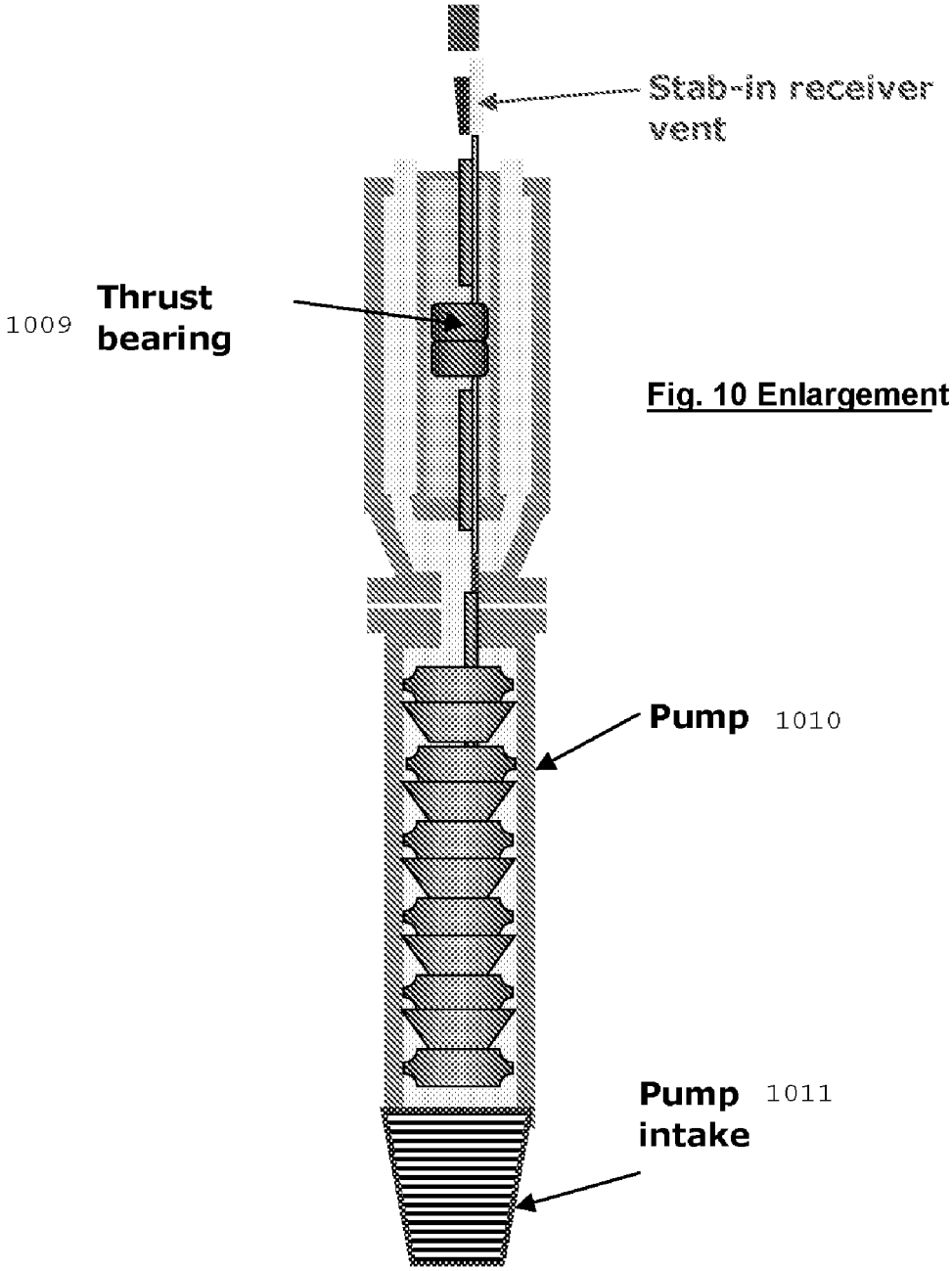
Fig. 10 Enlargement

DDP Bottom Hole Assembly
without drive tube

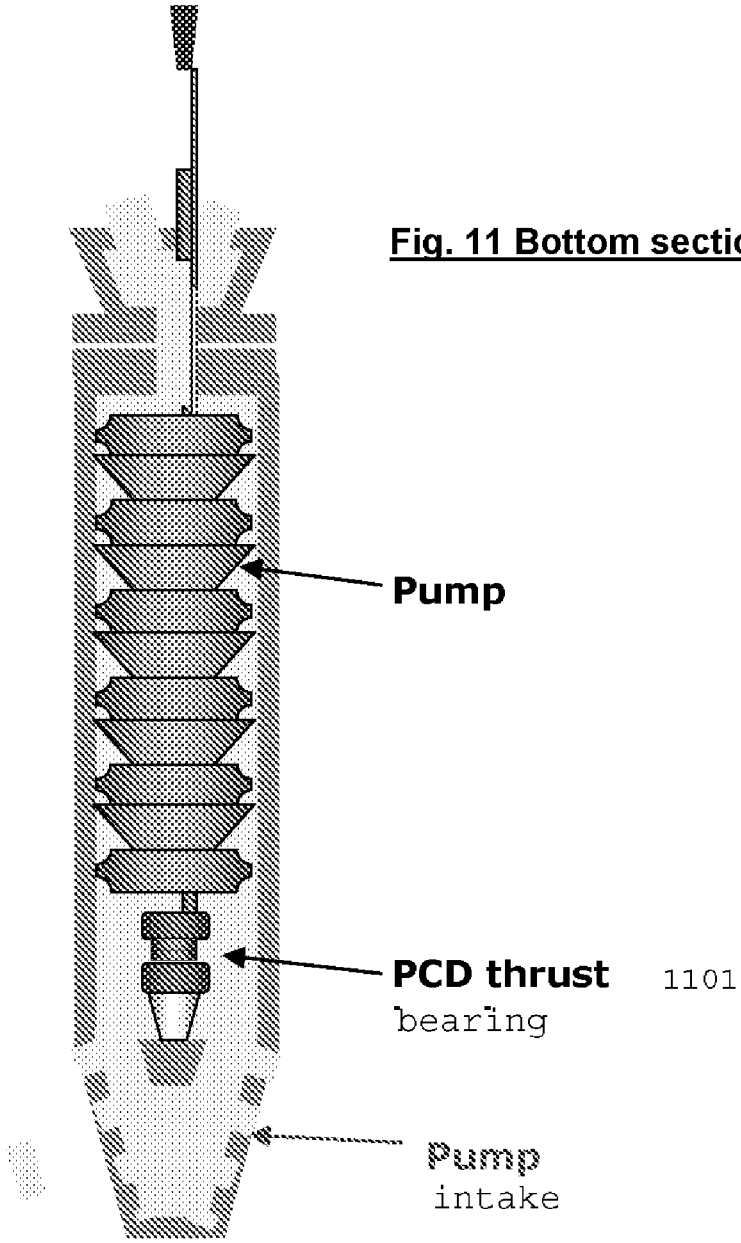
Fig. 11 Bottom section enlarged

SYSTEM AND METHOD FOR DIRECT DRIVE PUMP

FIELD OF INVENTION

The present invention relates to a system and method for a direct drive pump to be used for moving liquids and/or quasi-liquids. The present invention also relates to a system and method for the installation of a direct drive pump, for example, for high volume lifts from deep wells.

BACKGROUND

Current systems for deep well pumping involve electrical submersible pumps ("ESPs") or geared centrifugal pumps ("GSPs"). Such pumps are the current, principal methods used as artificial lifts in high rate oil wells, where a multi-stage centrifugal pump is located downhole. For example, in an ESP system, a downhole electrical motor directly drives the pump, with electric power supplied to the motor via a cable extending from the surface to the motor's location downhole. For example, in a GSP system, the pump is driven via a rotating rod string extending from the surface to a speed increasing transmission system located downhole. The speed increasing transmission system is used to increase the relatively slow rotation of the rod string to a much faster rotation, as needed by the pump. In this example, the rod string is driven by a prime mover at the surface.

In current systems, the artificial lift system tends to be a bit burdensome. For example, in the installation of a current artificial lift system, a 300 to 400 foot artificial pump is installed in 10 foot sections in assembly form. Likewise, in the maintenance of a specific section of the pipe or tubing, the entire section of the pump must be removed all at once before any maintenance can be made.

FIGS. 1A and 1B show example line shaft pumps. FIG. 1A shows a line shaft pump with water lubricated bearings. In FIG. 1A, the drive shaft is running directly inside the production tubing, or column pipe. Unlike the example shown in FIG. 1B, this pump does not use an oil pipe. Instead, in FIG. 1A, the drive shaft is centered within the column pipe by water lubricated bearings and bearing retainers attached to the column pipe. Such bearings are typically made of rubber, due to use in water. The pump thrust, as well as the weight of the drive shaft itself, are carried by a thrust bearing located at the surface.

FIG. 1B shows a line shaft pump with an oil pipe and oil lubricated bearings. In FIG. 1B, an oil lubricated drive shaft rotates inside the oil pipe, or oil filled tubular housing. The drive shaft is supported by shaft bearings, e.g., bronze bushings, attached fixedly to the oil pipe. The bushings are spaced, e.g., 5 feet to 10 feet, on yhr oil pipe and along the drive shaft depending upon the intended rotational speed of the drive shaft. In this example, the steel pump shaft forms the journals for the bronze bushings. The pump thrust, as well as the weight of the drive shaft itself, are carried by a thrust bearing at the surface. Accordingly, the oil pipe can be centered within the column pipe by elastomer centralizers spaced evenly along its length as shown in FIG. 1B.

In both FIGS. 1A and 1B, there is a required bearing spacing for adequate support of the drive shaft. Such spacing affects the configuration of the tubulars used in installation. For example, in a water lubricated system shown in FIG. 1A, if the drive shaft bearings are required every 10 feet, then the column pipe is used in 10 foot segments. The bearing retainers are fixed to the column pipe at the column pipe couplings. For example, in an oil lubricated system shown in FIG. 1B, if the drive shaft bearings are required every 10 feet, then the oil pipe is used in 10 foot segments. The bushings are fixed to the drive shaft housing at the housing couplings. In both examples, the pump systems can be installed in similar fashion. For example, if the bearing spacing is deemed to be 10 feet, then all of the components including the column pipe, oil pipe, and drive shaft, are in 10 foot length segments. Thus, as the pump is lowered into a well, each of the 10 foot segments of the drive shaft, bearings and column or oil pipe, must be installed in 10 foot segments.

Accordingly, a need exists for a less burdensome installation, de-installation, and maintenance of a pump system for both oil and water lubrication systems.

DETAILED DESCRIPTION

Figure 1A:
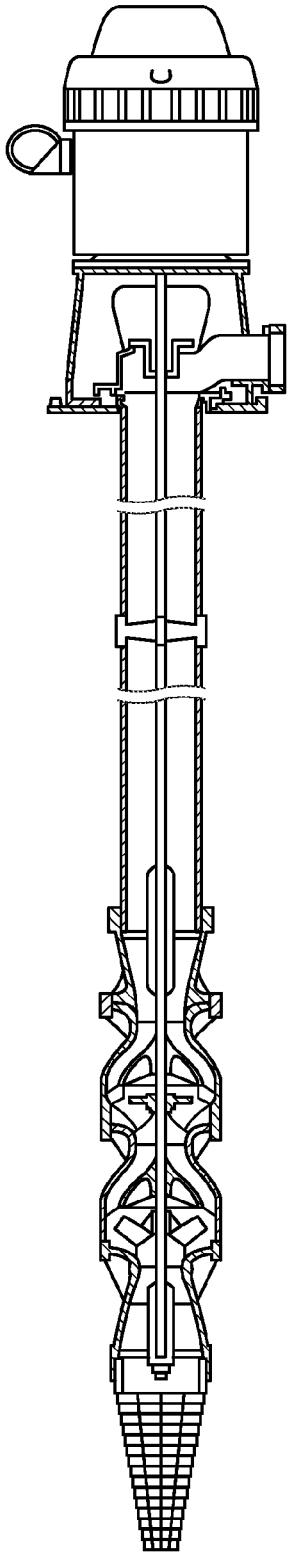
FIG. 1A shows a line shaft pump having water lubricated bearings.

Embodiments of the present invention provide for a relatively easy to install and maintain artificial lift pump for use in oil and water pump systems. More specifically, embodiments of the present invention may be used for deep well pumping of oil, water, or other fluid/quasi-fluid.

Embodiments of the present invention provide for a deep well pump system which can be utilized at a greater depth and/or with a greater rotational speed than current pump systems allow. For example, water wells tend to be relatively large in diameter, e.g., 10 inches to more than 16 inches. Accordingly, available agricultural centrifugal pumps used in water wells require large diameter pump rotor which produce a large increase in pressure per stage. That is, pressure per stage is proportional to the square of the rotor diameter, and the square of the rotational speed. Given the large diameter and typically shallow depth of a water well, water well turbine pumps typically are operated at speeds between about 1200 RPM and 1800 RPM. Comparatively, oil wells tend to use an about 5.5 inch or 7 inch production casing having an inside diameter of about 4.6 inches to 6 inches. Accordingly, available centrifugal pumps require a small diameter pump rotor, providing a small pressure increase per stage. This small pressure increase per stage results in the pump having to be operated at a high speed, e.g., about 3500 RPM. Even at such high speed, due to the small pressure increase per stage and the typically deep depth of oil wells, there can be as many as 250 or more stages required to bring the produced fluid to the surface or other desired location. If such pumps for oil production were operated at the typical speed of an agricultural pump (e.g., for a water well), about 1000 stages or more could be required to bring the produced fluid to the surface or other desired location, which would be prohibitively expensive and wearing on the system. In embodiments of the present invention, such restrictions and expense of the agricultural and oil pump systems are alleviated or diminished.

Embodiments of the present invention provide for a pump installation in which larger sections of the pump may be installed than current pump systems allow. For example, in agricultural and oil pumps, the drive shaft is stabilized by bearings that are fixed to either the tubular drive shaft housing, i.e., the oil pipe, or the column pipe. Each of these segments are made to be all the same length so that the bearings can be fixed to the column pipe or oil pipe at the junction of the segments of pipe as the pump is being installed into the well. In an oil lubricated bearing system, bronze bushings are attached to the oil pipes, with a steel drive shaft forming the journal. In a water lubricated bearing system, the rubber bearing is held in the center of the column pipe by the bearing retainers. The drive shaft runs through the rubber bearing and is fitted with a stainless steel sleeve serving as journal. In both the agricultural (e.g., water) and oil pump systems, the bearing is affixed to the column pipe or oil pipe, respectively. Accordingly, as discussed above, the installation of such available systems require assembly of each 10 feet of pump system segments. Embodiments of the present invention provide for installations of larger pump system segments, e.g., 25 foot sections, 60 foot sections, and more.

Embodiments of the present invention provide for a high volume artificial lift system, i.e., a direct drive pump ("DDP"), in which a multi-stage downhole centrifugal pump is driven by a rod string extending from the surface to the downhole pump. The rod string is driven at the surface, e.g., ground level, by a prime mover, e.g., an electric motor. For example, the motor may drive the rod string at a 3500 RPM pump operational speed. This speed can be decreased or increased, depending upon the situation needed, in embodiments of the present invention.

Embodiments of the present invention provide for closely spaced bearings to provide rotational stability of the drive string. In an embodiment, the individual bearings are attached to the drive string, and are not fixed to the production casing or drive tube.

Figure 2:
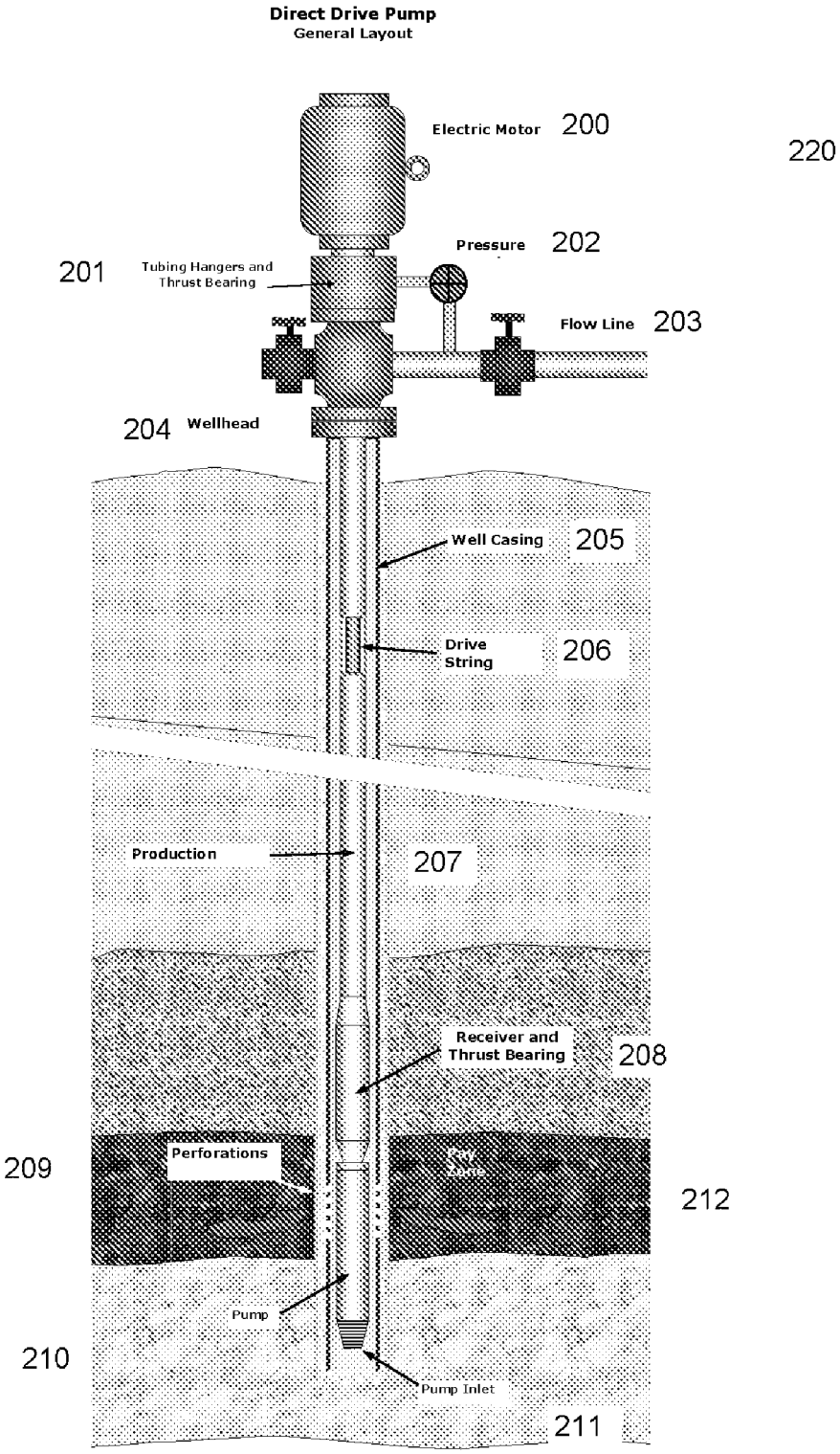
FIG. 2 shows an exemplary embodiment of a direct drive pump according to an embodiment of the present invention.

FIG. 2 shows an embodiment of a direct drive pumping system 220 according to the present invention. In FIG. 2, a motor 200 is shown connected to the remaining elements of the pump via tubing hangers and at least one thrust bearing 201. In an embodiment, the motor 200 is an electric motor which drives the rod string at full pump speed. Alternatively, the motor 200 is a direct drive motor, e.g., turning at 3500 RPM. Alternatively, the motor 200 has a low output RPM, i.e., lower than 3500 RPM, but with speed increasing capability gearing. In this embodiment, the pressure of the pump system is monitored by a pressure regulator 202 situated between the pump and the flow line 203 to the pump. The pressure regulator 202 opens when the pressure differential between the drive tube and the production tubing exceeds a predetermined, set value. A wellhead 204 couples the well casing to the upper portion of the pump system which includes the motor 200 and the flow line pipe 203. Inside the protective well casing 205, a production tubing or pipe 207 is situated and houses a drive rod string 206. The lower portion of the pump system includes a receiver and thrust bearing(s) 208. In an embodiment, the thrust bearing 208 carrying the weight of the drive rods is located in the surface drive head. Due to the high rotational speed, the rod string 206 is equipped with stabilizers or bearings closely spaced along the entire length of the rod string to assure stable rotation. Some example embodiments of such stabilizers are shown herein. Perforations 209 in the well casing in the pay zone 212 area, i.e., where the water or oil or other liquid/quasi-liquid is located, allow for entry of the liquid or quasi-liquid into the well casing for pumping via the pump 210 having a pump inlet 211, up to the surface or other desired location.

Figure 3:
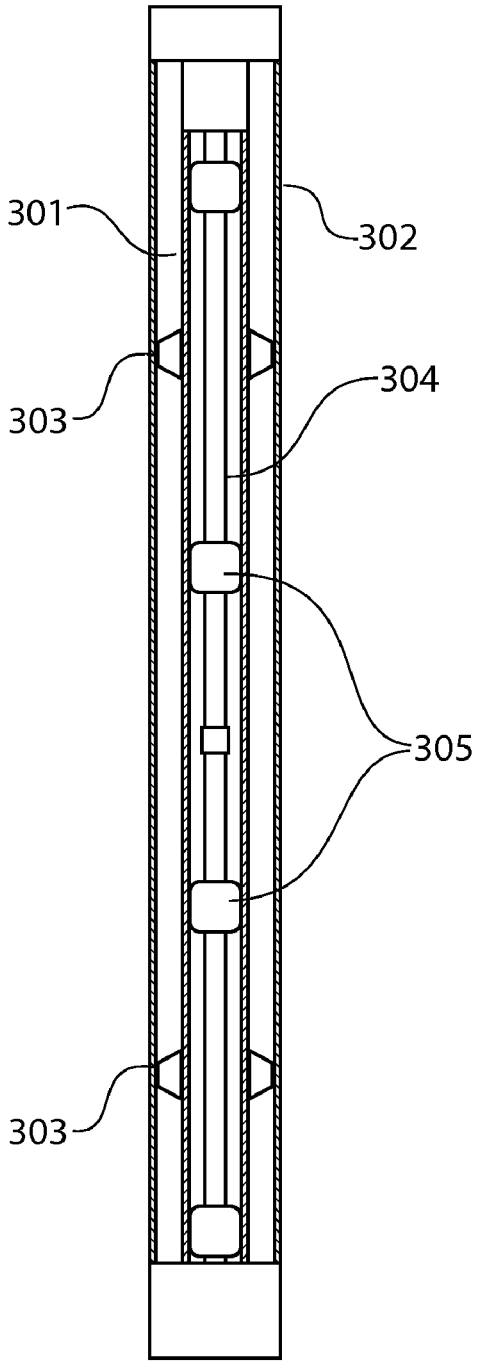
FIG. 3 shows an exemplary embodiment of a drive rod with a drive tube according to an embodiment of the present invention.

FIG. 3 shows an embodiment of a drive rod 304 having a drive tube 301 according to an embodiment of the present invention. For example, in larger sizes of production tubing, the drive rod string 304 and stabilizers 305 rotate within a small diameter tubular housing called a drive tube 301. The drive tube 301 runs inside the production tubing 302. In order to stabilize the drive tube 301, drive tube stabilizers 303 are spaced between the production tubing 302 and the drive tube 301. Within the drive tube 301 itself, the drive rod string 304 is supported by drive rod stabilizers 305 to the drive tube 301.

Figure 4:
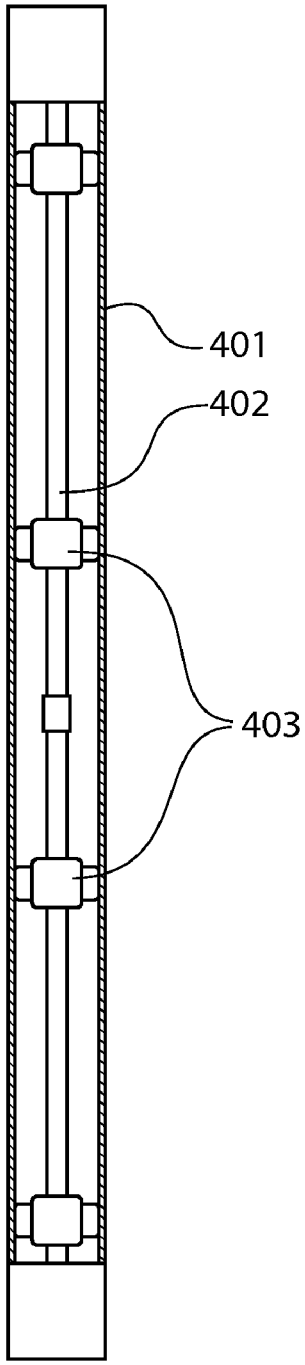
FIG. 4 shows an exemplary embodiment of a drive rod without a drive tube according to an embodiment of the present invention.

FIG. 4 shows an embodiment of a drive rod string 402 being encased directly in production tubing 401. In such case, the drive rod string 402 is supported by drive rod stabilizers 403 to the production tubing 401. Such an embodiment may be used in the situation of a relatively small diameter production tubing, where there is insufficient and/or no need for a drive tube.

Figure 5:
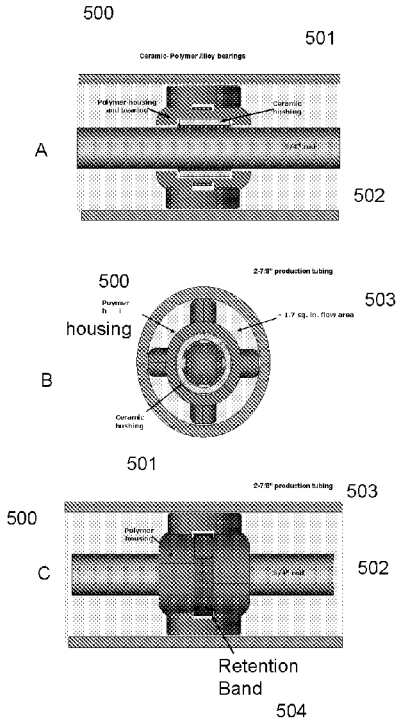
FIG. 5A shows a cross-sectional view of a stabilizer embodiment for the direct drive pump according to an embodiment of the present invention.
FIG. 5B shows a top view of a stabilizer embodiment for the direct drive pump according to the embodiment of the present invention shown in FIG. 5A.
FIG. 5C shows a front view of a stabilizer embodiment for the direct drive pump according to the embodiment of the present invention shown in FIG. 5A.
Figure 6:
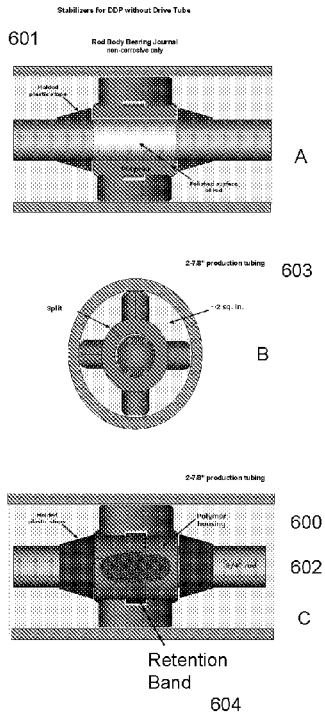
FIG. 6A shows a cross-sectional view of a stabilizer embodiment for the direct drive pump according to an embodiment of the present invention.
FIG. 6B shows a top view of a stabilizer embodiment for the direct drive pump according to the embodiment of the present invention shown in FIG. 6A.
FIG. 6C shows a front view of a stabilizer embodiment for the direct drive pump according to the embodiment of the present invention shown in FIG. 6A.
Figure 7:
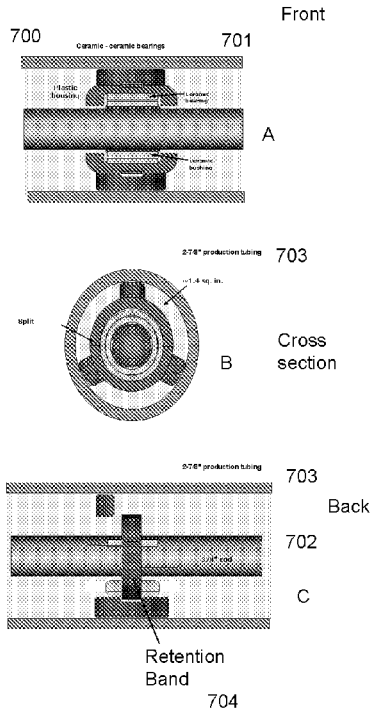
FIG. 7A shows a cross-sectional view of a stabilizer embodiment for the direct drive pump according to an embodiment of the present invention.
FIG. 7B shows a top view of a stabilizer embodiment for the direct drive pump according to the embodiment of the present invention shown in FIG. 7A.
FIG. 7C shows a front view of a stabilizer embodiment for the direct drive pump according to the embodiment of the present invention shown in FIG. 7A.
Figure 5A:
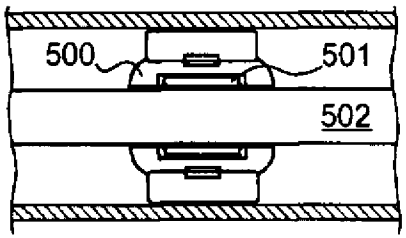
Figure 5B:
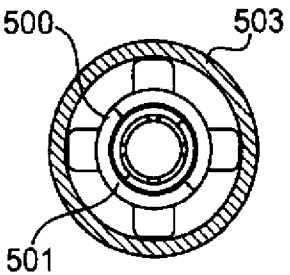
Figure 5C:
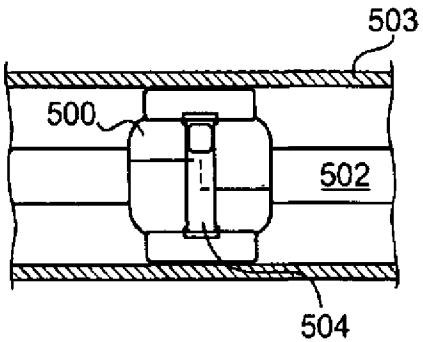

FIGS. 5, 6, and 7, show embodiments of bearing assemblies or stabilizers for a direct drive pump embodiment which does not utilize a drive tube according to the present invention. In each of these embodiments, the bearing assembly includes a bushing attached to a rod body, with a bearing mounted in a housing, e.g., a plastic or other type housing, that closely fits the internal diameter of the production tubing. The housing, and thus, the bearing, remain fixed relative to the tubing with the rod string rotating within the bearing. FIG. 5 shows a ceramic-polymer alloy bearing example embodiment. In FIG. 5A, a polymer housing and bearing 500 are situated near a ceramic bushing 501, the ceramic bushing 501 being situated on the drive rod 502. In FIG. 5B, the polymer housing and bearing 500 surrounding the ceramic bushing 501 are shown. A resulting flow area is available outside of the polymer housing 500. In FIG. 5C, a front view of the assembly is shown in which inside the production tubing 503, a retention band 504 is used to hold the housing 500 which surrounds a portion of the drive rod 502.

Figure 6A:
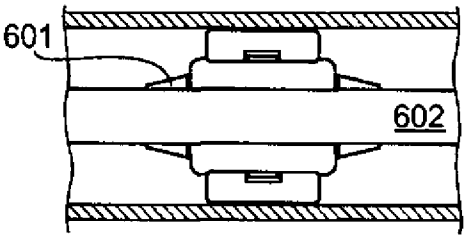
Figure 6B:
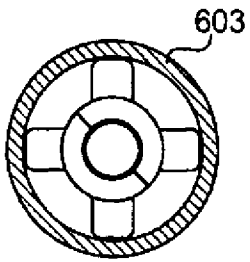
Figure 6C:
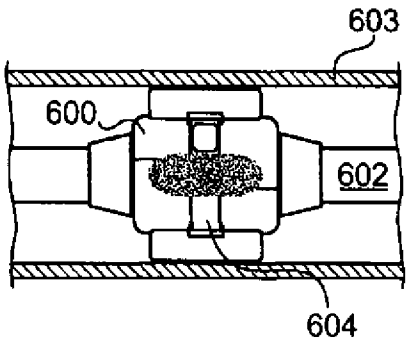

FIG. 6 shows a non-corrosive bearing example embodiment. In FIG. 6A, a polymer housing and bearing 600 are situated near a molded stop 601, e.g., a molded plastic stop, the molded stop 601 being situated on the drive rod 602. In FIG. 6B, the polymer housing and bearing 600 surrounding the drive rod 602 are shown. A resulting flow area is available outside of the polymer housing 600. In FIG. 6C, a front view of the assembly is shown in which inside the production tubing 603, a retention band 604 is used to hold the housing 600 which surrounds a portion of the drive rod 602.

Figure 7A:
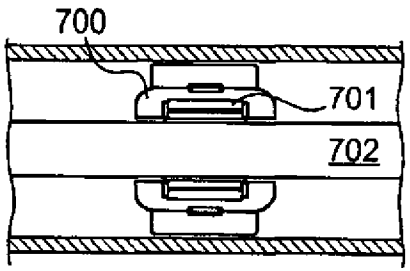
Figure 7B:
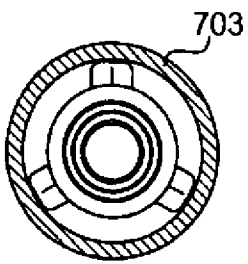
Figure 7C:
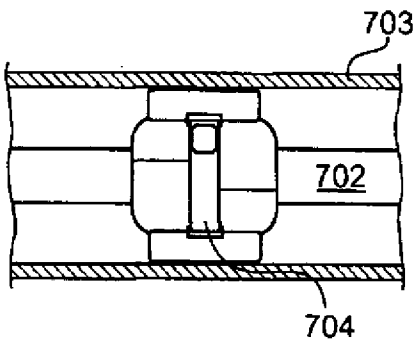

FIG. 7 shows a ceramic bearing example embodiment. In FIG. 7A, a plastic housing and bearing 700 are situated near a ceramic bushing 701, the ceramic bushing 701 being situated on the drive rod 702. In FIG. 7B, the plastic housing and bearing 700 surrounding the ceramic bushing 701 are shown. A resulting flow area is available outside of the plastic housing 700. In FIG. 7C, a front view of the assembly is shown in which inside the production tubing 703, a retention band 704 is used to hold the housing 700 which surrounds a portion of the drive rod 702.

In embodiments of the present invention, the bearing material to be used depends upon the wear and lateral load expected at the bearing's location within the well. For example, where high lateral loading is expected due to bore hole deviations, ceramic or even carbide bearings can be used. Or, for example, where not much side loading is expected, simpler and less expensive polymer alloy bearings can be used. The bearing housing material can be plastic, nylon, polymer alloy, or some other strong, chemically inert material.

In embodiments of the present invention, various types of bearings can be used. Determining which bearing type to use can depend upon the expected load, depth of the pump, use of a drive tube, and other considerations. In FIGS. 5 to 9, the bearings differ in the provision for fluid flow around the bearing housing. For example, when a drive tube is not used, the bearings are exposed to the production fluid flow, thus the area open to flow between the bearing housing and the inside of the production tubing should be maximized to reduce pressure losses as the fluid flows past the bearings. See, e.g., FIGS. 5 to 7. Or, for example, when a drive tube is used, the fluid in the tube is virtually stagnant, and the bearing housings need only be fluted enough to allow for a low rate flow communication throughout the drive string. See, e.g., FIGS. 8 and 9.

Figure 8:
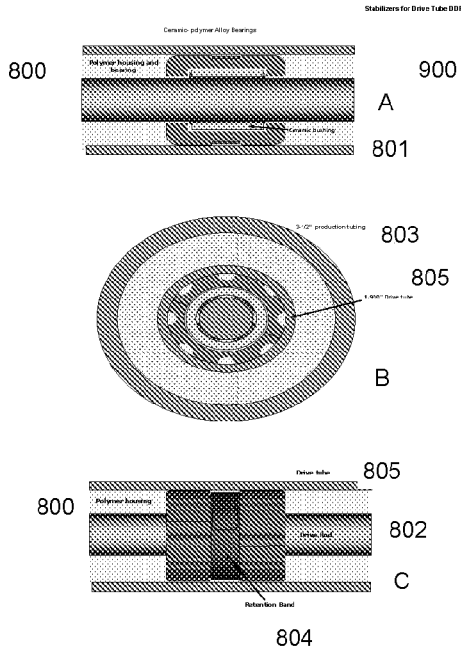
FIG. 8A shows a cross-sectional view of a stabilizer embodiment for the direct drive pump according to an embodiment of the present invention.
FIG. 8B shows a top view of a stabilizer embodiment for the direct drive pump according to the embodiment of the present invention shown in FIG. 8A.
FIG. 8C shows a front view of a stabilizer embodiment for the direct drive pump according to the embodiment of the present invention shown in FIG. 8A.
Figure 9:
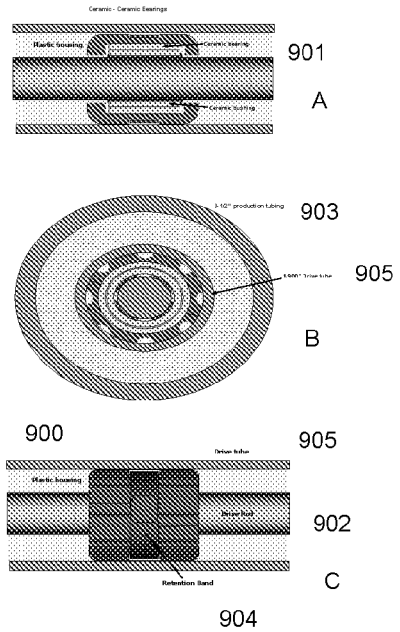
FIG. 9A shows a cross-sectional view of a stabilizer embodiment for the direct drive pump according to an embodiment of the present invention.
FIG. 9B shows a top view of a stabilizer embodiment for the direct drive pump according to the embodiment of the present invention shown in FIG. 9A.
FIG. 9C shows a front view of a stabilizer embodiment for the direct drive pump according to the embodiment of the present invention shown in FIG. 9A.

FIGS. 8 and 9 show embodiments of bearing assemblies or stabilizers for a direct drive pump embodiment having a drive tube according to the present invention. In each of these embodiments, the bearing assembly includes a bushing attached to a rod body, with a bearing mounted in a housing, e.g., a plastic or other type housing, that closely fits the internal diameter of the drive tube housing. The housing, and thus, the bearing, are situated to remain fixed relative to the drive tube housing with the rod string rotating within the bearing.

Figures 8A, 8B, 8C:
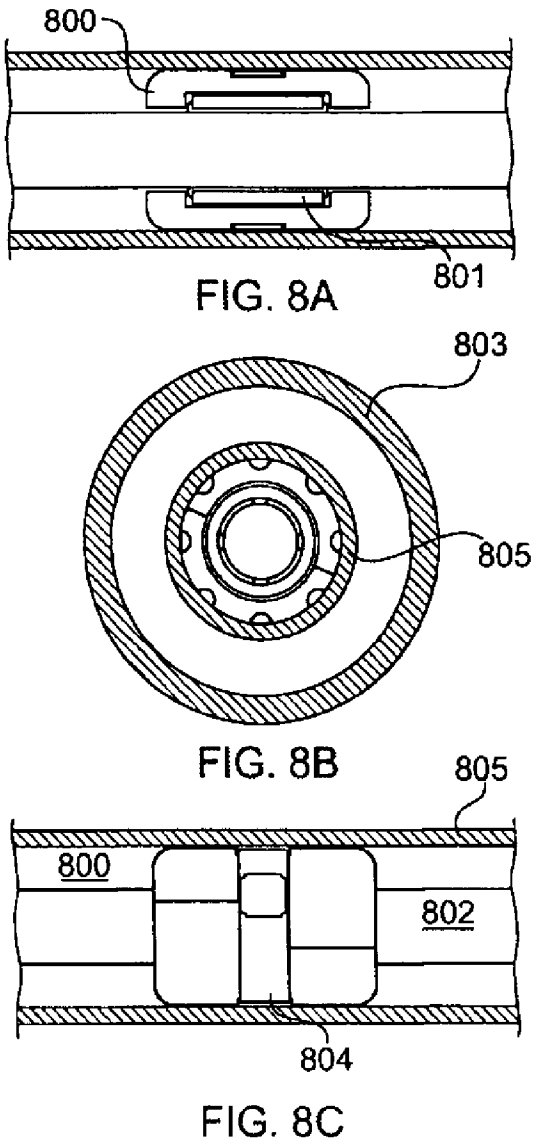
Figure 10:
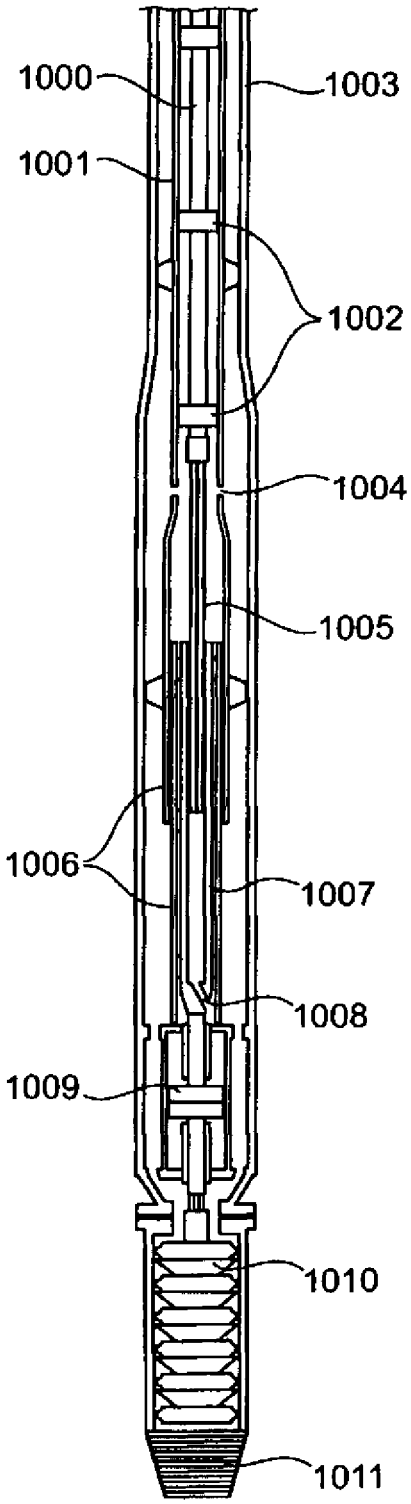
Figure 11:
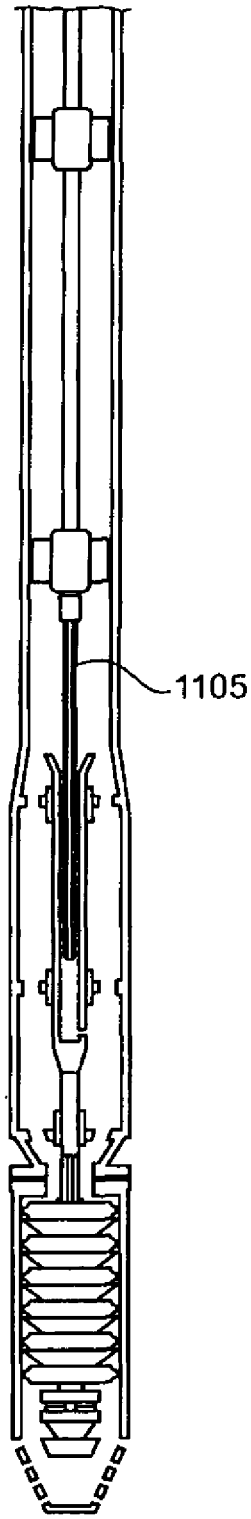
Figure 12:
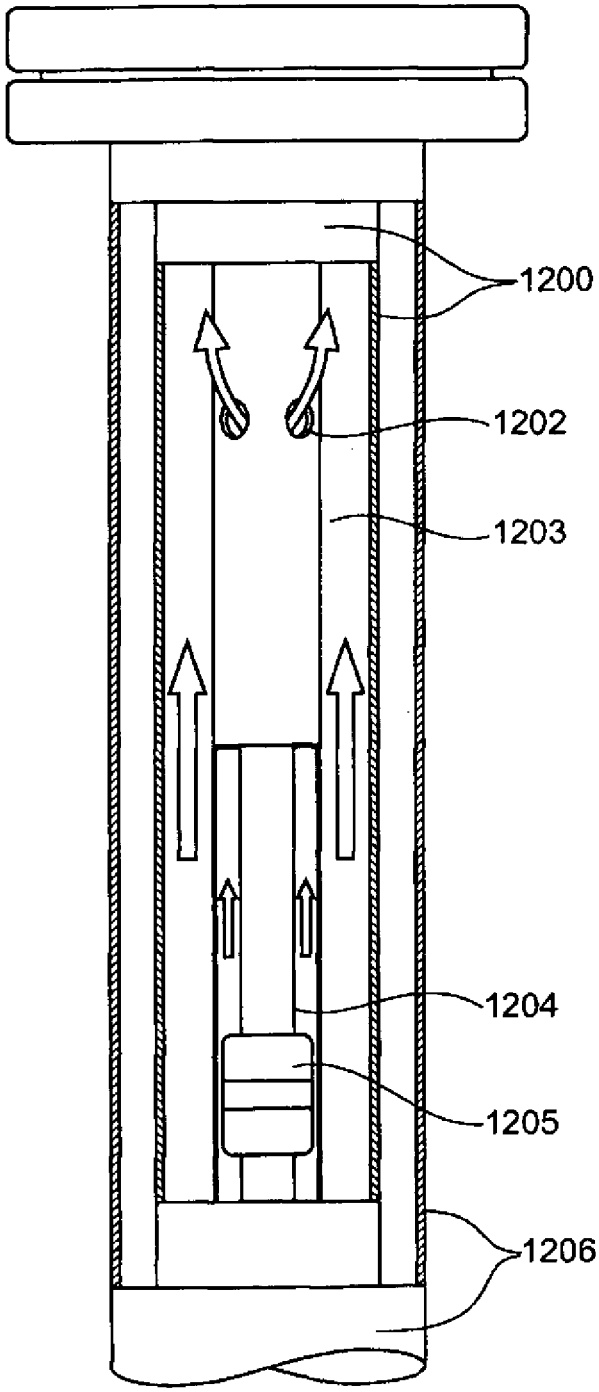

FIG. 8 shows a ceramic-polymer alloy bearing example embodiment. In FIG. 8A, a polymer housing and bearing 800 are situated near a ceramic bushing 801, the ceramic bushing 801 being situated on the drive rod 802. A drive tube 805 surrounds this assembly. In FIG. 8B, the production tubing 803 surrounds the drive tube 805 which surrounds the bearing assembly. In FIG. 8C, a front view of the assembly is shown in which within the drive tube 805, a retention band 804 is used to hold the housing 800 which surrounds a portion of the drive rod 802.

Figures 9A, 9B, 9C:
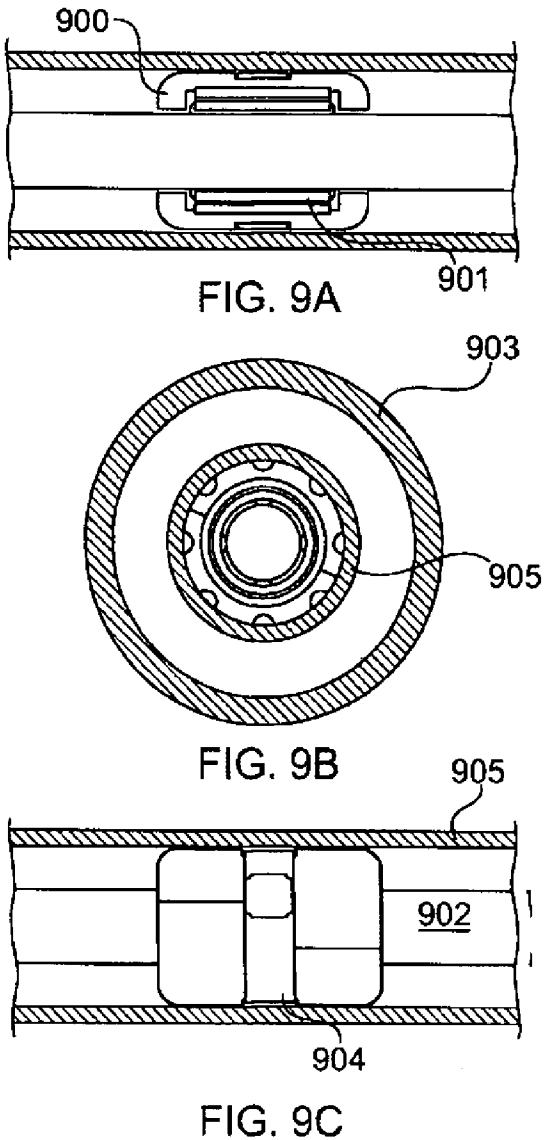

FIG. 9 shows a ceramic bearing example embodiment. In FIG. 9A, a plastic housing and bearing 900 are situated near a ceramic bushing 901, the ceramic bushing or bearing 901 being situated on the drive rod 902. A drive tube 905 surrounds this bearing assembly. In FIG. 9B, the production tubing 903 is shown surrounding the drive tube 905 which surrounds the bearing assembly. In FIG. 9C, a front view of the assembly is shown in which inside the drive tube 905, a retention band 904 is used to hold the housing 900 which surrounds a portion of the drive rod 902.

Figure 1B:
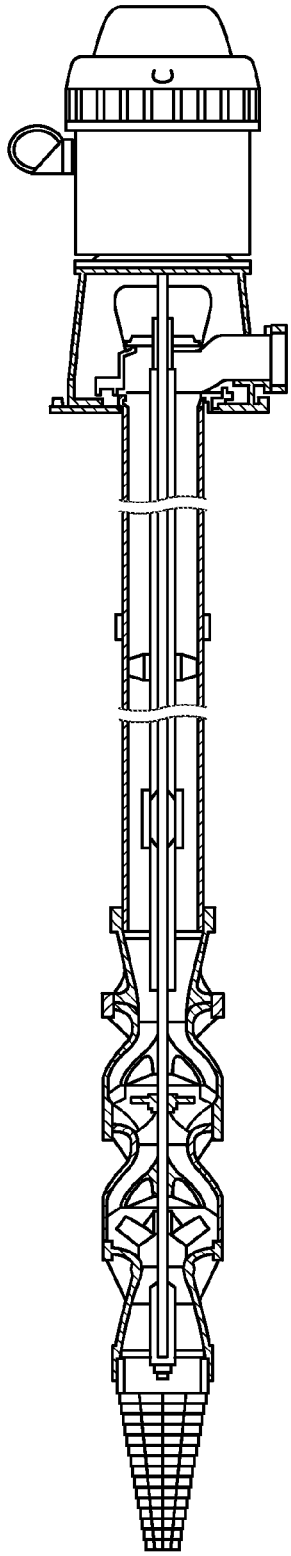
FIG. 1B shows a line shaft pump with oil lubricated bearings.

In embodiments of the present invention, the bearing assembly, or configuration, provides that the tubulars and the drive string can be run separately and sequentially, rather than simultaneously as done in currently available pump systems. In embodiments of the present invention, the bearing assembly allows for individual segments of pipe and drive string to be much longer since the bearings are not attached to the tubulars' couplings. Thus, the couplings can be spaced much more widely, without having to adjust for the earlier necessary placement of bearings. Accordingly, this allows for relatively easier service and maintenance of the pump system. For example, when the pump requires service, the drive rods and/or tubulars can be pulled from and subsequently rerun into the well in large lengths, e.g. several feet, 100 foot lengths, etc., at a time. Further, in an embodiment, the tubing couplings are threaded, instead of having flange couplings, e.g., as shown in FIGS. 1A and 1B, thus greatly improving seal integrity and speed of installation.

In an embodiment of the present invention, mounting such bearing assemblies on a drive rod allows the bearings to be located optimally as required by the conditions in the well. For example, such conditions may include rod tension and potential side loads in the well due to, e.g., borehole deviation. In an example, the rotational stability of a drive string is a function of rod tension. That is, the higher the tension, the more stably the rod will rotate. However, at the bottom of the hole, near the pump, the rod may have little tension. Thus, at this location of the pump in the well, the bearing spacing needs to be the closer in space in order to assure stable rotation. Likewise, proceeding up the hole toward the surface, the tension of the rod increases as the weight of the rod hanging below effectively is increased. Thus, the spacing of the bearings can be increased in this area. That is, where the rod tension is greatest, the relative bearing spacing along the drive rod may be the widest and still be adequately effective. In an embodiment of the present invention, an optimized drive rod string has bearings spaced according to the requirements dictated by the rod tension.

In a practical situation, wells—oil or water—are frequently neither perfectly straight nor vertical. Thus, a drive rod rotating within tubing with a small diameter may be forced to the side by deviations of the direction of the well, causing lateral loads on the bearings situated in and/or near the area of the deviation. The drive rod bearings are principally designed to keep the rod string rotating stably, and are normally expected to exposed to only small lateral loads. However, if side loads are expected to be unusually high due to borehole deviations, special bearings designed for side-load resistance can be installed in those areas where high lateral load is expected, e.g., the ceramic bearings as shown in FIGS. 5 to 9.

In embodiments of the present invention, relatively easy maintenance is needed due to the structure of the pump system. In an embodiment, the drive rod(s) can be removed without having to remove the other components. Such allows for relatively easy "tuning" or adjustment of the pump system for changing/changed operational conditions, or for normal maintenance. For example, if an operation condition such as pump speed is changed, the drive rod(s) can be replaced with other drive rod(s) having a more useful bearing type, configuration, and/or distribution. For example, if the pump speed is increased in order to increase liquid production, the drive rods can be easily replaced with one with a different distribution of bearings that is designed for the higher rotational speed. Likewise, if there is a failure in one or more of the drive rods, a replacement drive rod(s) can be quickly run downhole thus minimizing downtime.

Embodiments of the present invention provide for pumping at greater depths. Presently available line shaft pump systems typically have a head capacity of less than 1500 feet, and are run to depths of less than 1000 feet. The relatively short length of the pipes and drive shaft results in a small amount of stretch by the components due to, e.g., water column weight and/or pump thrust, during operation. Such stretch allows the supporting thrust bearing for the drive shaft to be located at the surface. See, e.g., FIGS. 1A and 1B, described above. This allows for small manual adjustments to the relative length of those components so that the pump impellers—which are fixedly attached both torsionally and axially to the drive shaft—turn freely. In embodiments of the present invention, however, given the greater depth of the components allowed, and consequently the greater hydrostatic forces, there is a much greater relative movement between the production tubing to which the pump is attached and the drive rods and/or drive tube, allowing for a more flexible range of manual adjustment.

Figure 10:
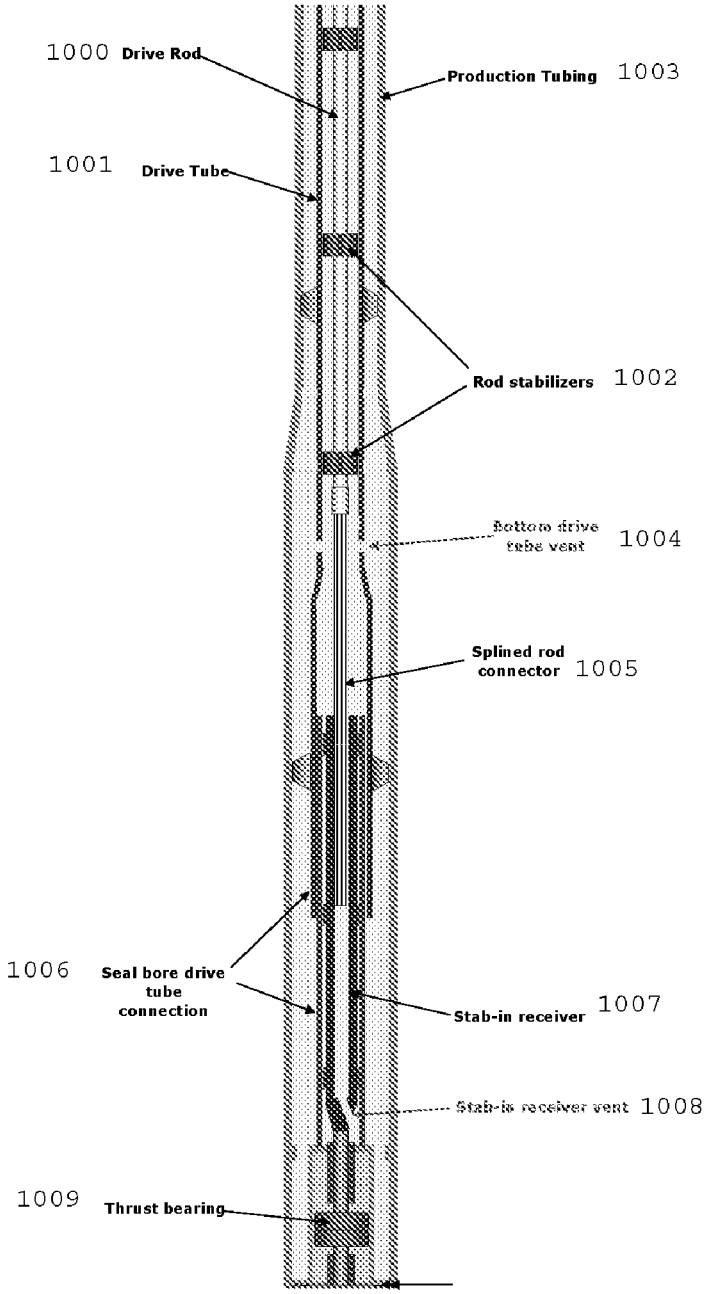
FIG. 10 shows an embodiment of a direct drive pump bottom hole assembly with a drive tube according to the present invention.

In FIG. 10, an embodiment of the direct drive pump hole assembly having a drive tube according to the present invention is shown. In such an embodiment, the pump drive shaft thrust bearing can be placed immediately above or below the pump. The pump drive shaft and rotors are driven by the drive rod(s) 1000 via a spline coupling or spline rod connector 1005 that allows for significant relative vertical movement of production tubing and the drive rod(s) 1000 while allowing the pump drive shaft and rotors to remain axially fixed relative to the pump body. In an embodiment, there is an additional thrust bearing located at the surface to handle the weight of the drive string. See, e.g., FIG. 2. In FIG. 10, the production tubing 1003 surrounds the drive tube 1001 which surrounds the drive rod 1000. Stabilizers 1002 are located on and spaced to support the drive rod 1000. Within the drive tube 1001 itself, is a bottom drive tube vent 1004. FIG. 10 further shows the relationship and relative locations of a seal bore drive tube connection 1006, stab-in receiver 1007, stab-in receiver vent 1008, thrust bearing 1009, pump 1010, and pump intake 1011.

Figure 11:
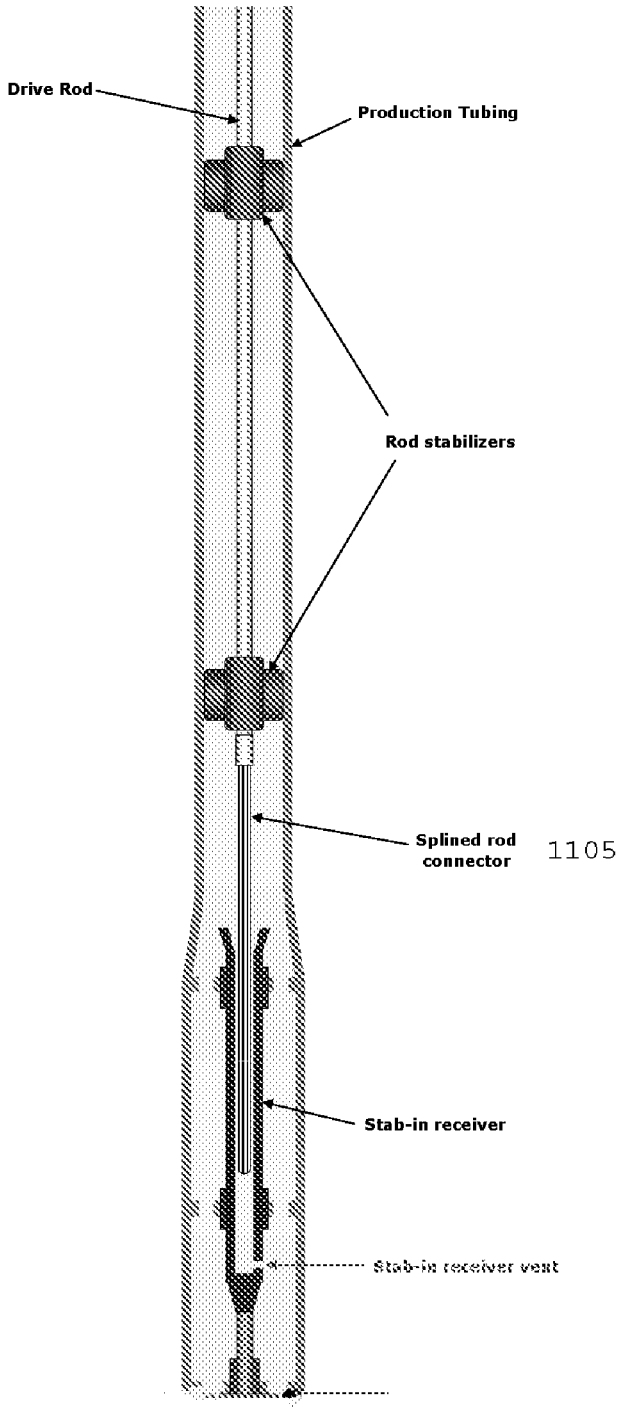
FIG. 11 shows an embodiment of a direct drive pump bottom hole assembly without a drive tube according to the present invention.

FIG. 11 shows an embodiment of the present invention similar to that shown in FIG. 10, except without a drive tube 1001. In this embodiment, a spline coupling 1105 is still employed. Further, use of a thrust bearing 1101, e.g., a polycrystalline diamond (PCD) thrust bearing, is shown situated below the pump and above the pump intake.

Figure 12:
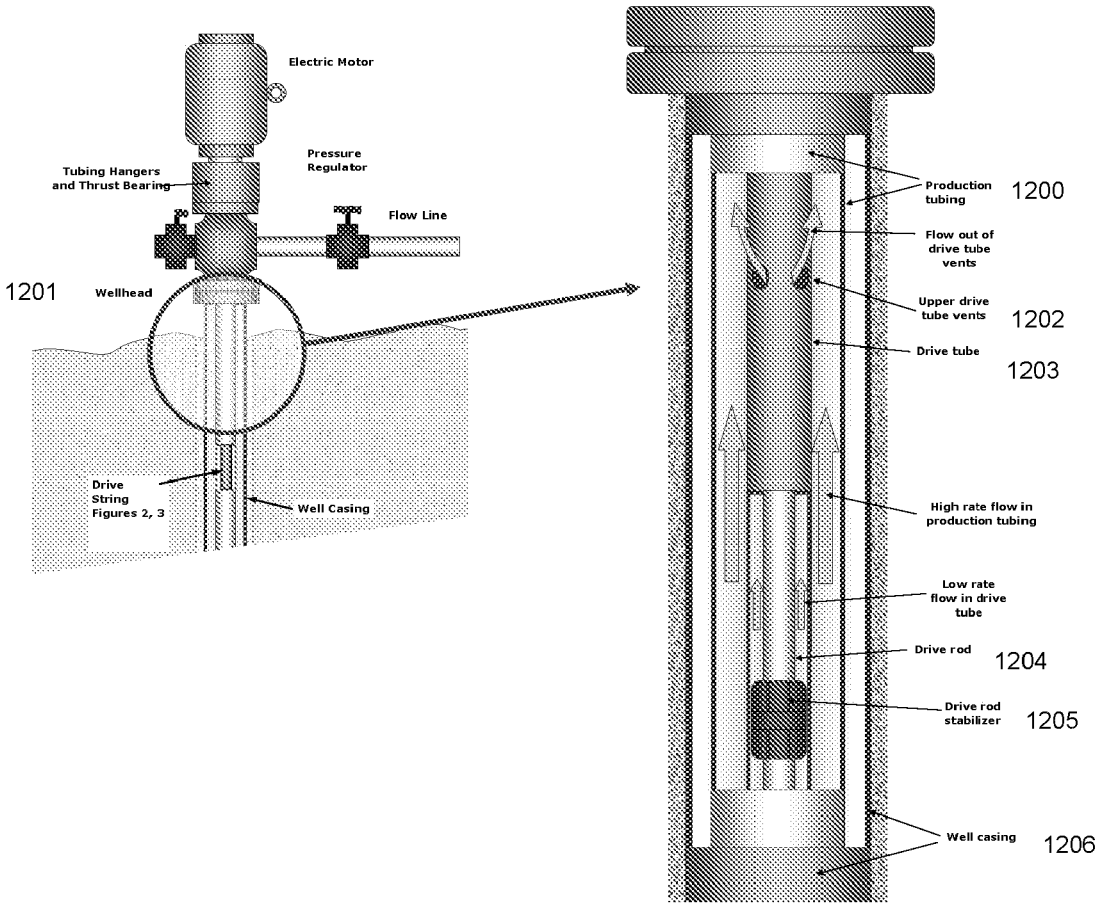
FIG. 12 shows an embodiment of a top vented drive tube according to the present invention.

FIG. 12 shows an embodiment of the present invention having a top vented drive tube. FIG. 12 shows an enlarged section of the pump system just below the wellhead 1201. A well casing 1208 surrounds the production tubing 1200, the production tubing 1200 surrounding the drive tube 1203. The drive tube 1203 is shown having vents 1202 in its upper area to allow for fluid flow. As the drive rod 1204 located within the drive tube 1203 moves in operation, the drive rod stabilizers 1205 are located on and support the rod. In operation of the embodiment, fluid flow in the production tubing 1200, within the drive tube 1203, and from the drive tube 1203 moves upward toward the surface.

In embodiments of the present invention, various lubricants can be used for the bearings. For example, in an embodiment having a large production housing or tubing, a drive tube having a smaller diameter can be utilized to encase the drive rod. The drive tube may be centralized within the production tubing, and be used to essentially protect the drive rod from corrosion and scale deposition that might occur in the flow stream of a produced fluid. In such an embodiment, lubrication of the bearings must be chosen so as to not negatively affect other parts of the system, e.g., sealing between components, etc. For example, in some systems, oil is used as a lubricant. In such systems, an oil lubricant can be useful at relatively shallow depths. However, using an oil lubricant at relatively greater depths can cause sealing issues between the produced fluid in the production tubing and the oil in the drive tube. Such issues can occur because of the difference in the density of the lubricating oil and the produced well fluid, e.g., typically water. For example, at deep depths, e.g., 6000 feet, the pressure difference between a column of lubricating oil with a specific gravity of 0.9, and water, with a specific gravity of 1.0, is nearly 260 psi at 6000 foot depth. And, in a pumping system, if the produced fluid and the lubricating oil are to be kept separate, the seals at the bottom of the oil filled drive tube must seal against this 260 psi pressure differential at 3500 RPM. This pressure situation can presents potential operational difficulties. In the alternative, one can pressure up the oil column at the surface to 260 psi so that the bottom hole pressures of the oil column and the produced fluid column are equal, or nearly so, relieving the pressure differential across the seals. This alternative also present operational difficulties. For example, if there are any changes in surface producing pressures, and during well shut-downs and start-ups, the surface pressure in the drive tube will need to be adjusted to the expected changes in bottom hole producing pressure. In another alternative, an oil lubricant having a similar density to that of water can be used so that the hydrostatic pressure in both columns is about equal at the bottom of the hole. This too presents difficulties in that such oils are synthetic, and thus, cost prohibitive. In embodiments of the present invention, these difficulties are overcome. For example, a water lubricated drive shaft in an embodiment of the present invention provides the benefits of the oil lubricated system without the operation difficulties, lubricant costs, and/or pressure balancing issues. The water lubricated system involves the drive shaft turning within a small diameter drive tube, and equipped with closely spaced bearings to provide rotational stability, as discussed herein. In an embodiment, the drive tube is not sealed off from the produced fluid. The produced fluid fills the drive tube and serves as the bearing lubricant. In such an embodiment using water as a lubricant, bearings designed for water lubrication can be used. Such bearings can designed using ceramic, carbide, or polymer alloy bearings, depending upon the load and wear requirements, as discussed herein. As shown in FIG. 12, the drive tube is vented to the production flow line at the surface to expel oil or gas that collects in the tub, and to allow the rate of flow up the drive tube to be controlled. In an embodiment, the drive tube is vented into the production tubing below the wellhead, allowing produced fluid to flow continuously up the drive tube. This can improve lubrication and/or improve the cooling of the bearings. In an embodiment, using a produced fluid filled drive tube can provide both cost and reliability benefits. In this embodiment, the drive shaft seals at the pump assembly are not needed. Instead, a bushing, e.g., carbide, is used to center the shaft at the bottom of the drive tube. The drive tube is vented at the bottom to allow the free movement of produced fluid into the drive tube, assuring that the drive shaft bearings are always immersed in fluid. In an embodiment, if the produced fluid is either corrosive or prone to scale deposition, the production line vented option can be used, as the flow rate up the drive tube could be closely controlled so that the fluid in the drive tube would be essentially stagnant. Thus, any potential for corrosion or scale formation on the drive string and/or bearings is greatly reduced. In such an embodiment, any remaining scale and corrosive components in the resulting stagnant column of water would have minimal effect given the lack of continuous movement.

In an embodiment, the drive tube is open to the pump outlet, thus, when it is completely filled with liquid, the pressure in the tube at the surface will be equal to the pump outlet pressure less the hydrostatic pressure exerted by a static liquid column. The pressure at the production tubing outlet at the surface will be equal to the pump outlet pressure less the hydrostatic pressure exerted by a static liquid column less the frictional pressure drop due to fluid flow in the production tubing. Thus, as long as there is flow in the tubing, the pressure at the top of the drive tube will be greater than the surface production tubing pressure, the difference being the pressure drop due to flowing friction. This difference can be used to purge the gas that will naturally accumulate at the top of the drive tube. Since the drive tube is open to the well's production fluid, some gas and/or oil may migrate up the drive tube during production. Eventually, the oil and/or gas will completely displace the water in the drive tube. The situation is more serious if gas fills even a portion of the tube since the upper bearings can become starved of liquid lubricant, resulting in eventual bearing failure.

In an embodiment, a drive tube can be fitted with vent line to the production tubing outlet, and the line can be equipped with a pressure regulator that opens when the pressure differential between the drive tube and the production tubing exceeds a set value. In the situation of possible accumulation of oil and/or gas in the drive tube, the pressure setting for the pressure regulator may need to be set after taking into account a higher than the expected friction loss pressure drop, so that the valve opens only after such accumulations occur. Thus, as oil and gas accumulate at the top of the drive tube, the pressure-regulated valve can be set to open periodically to vent some of the oil and gas from the tube, keeping a constant amount of water in the drive tube so that the bearings are always lubricated.

In an embodiment where neither corrosion nor scale deposition is of great concern, then the drive tube-venting embodiment can be used. In this embodiment, the drive tube is vented at the bottom, but there is an additional drive tube vent into the production tubing just below the wellhead as shown in FIG. 12. During production operations, there may be a significant frictional pressure drop in the production tubing between the bottom hole and the surface, due to the high rate of flow in the production tubing. Consequently, there is a greater fluid pressure inside the drive tube at the surface than in the adjacent production tubing. This differential can be used to force a low rate fluid to flow up the drive tube and out the top vent, resulting in a continual circulation of produced fluid up the drive tube, lubricating and cooling the bearings. Any oil and/or gas entering the drive tube would also pass through the top vent, eliminating the chance of gas accumulation causing lack of adequate lubricant, as described above.

In the embodiments, an effective cooling and lubrication of the stabilizer bearings is provided by the constant flow of water. See, e.g., FIG. 12. Such cooling and lubrication may be critical in deviated well situations, since the stabilizer bearings experience heavier side loads due to the bending of the drive string. In an embodiment, the production line venting also can provide continuous flow of produced fluid up the drive tube to both cool the bearings situated in that area. Further the production line venting can provide for continuous purging of any oil and/or gas that accumulates in the drive tube by merely opening a control valve to allow the desired amount of liquid to continuously flow up the drive tube and into the production flowline.

Figure 13:
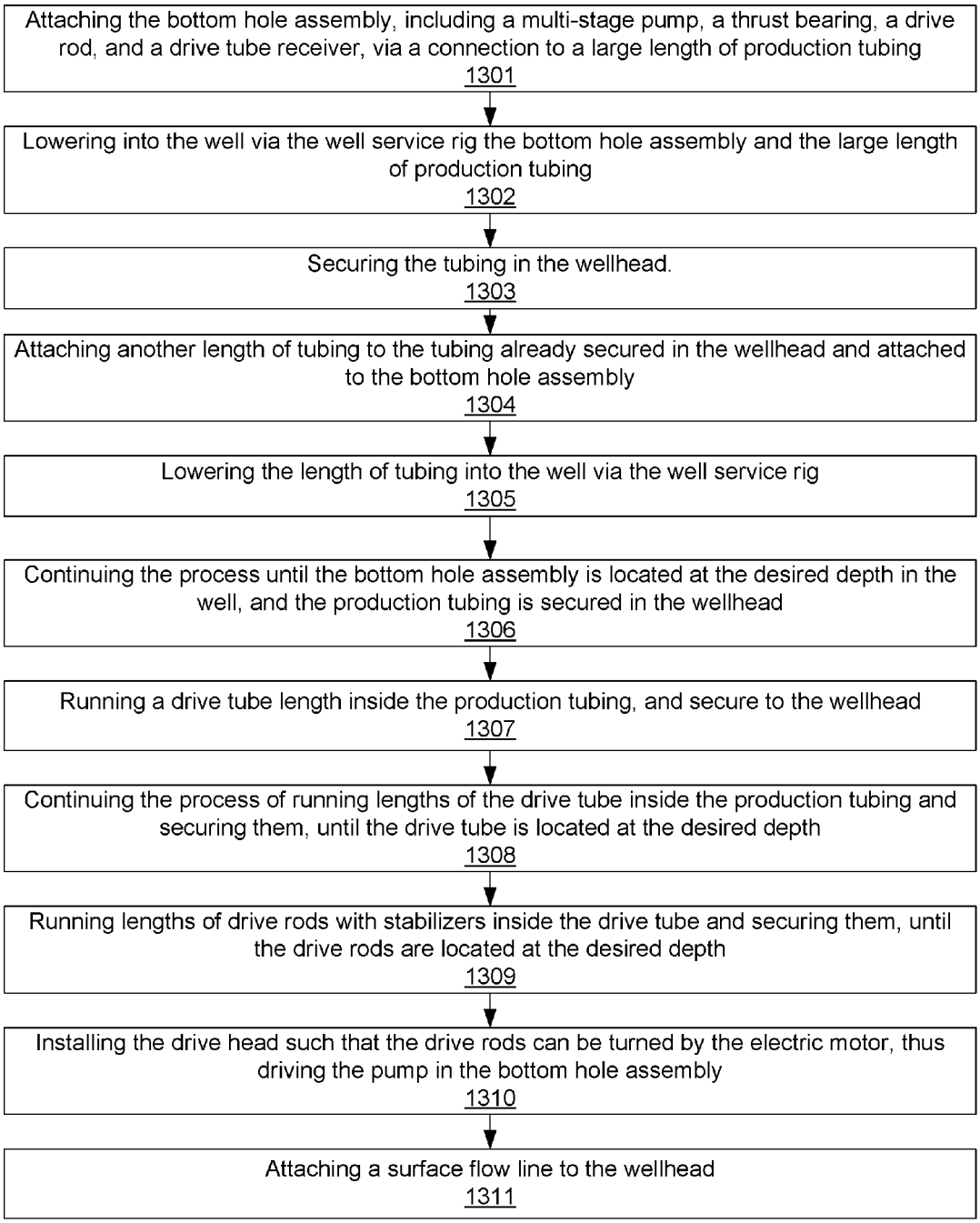
FIG. 13 shows an embodiment method for installing a direct drive pump according to the present invention.
Figure 2:
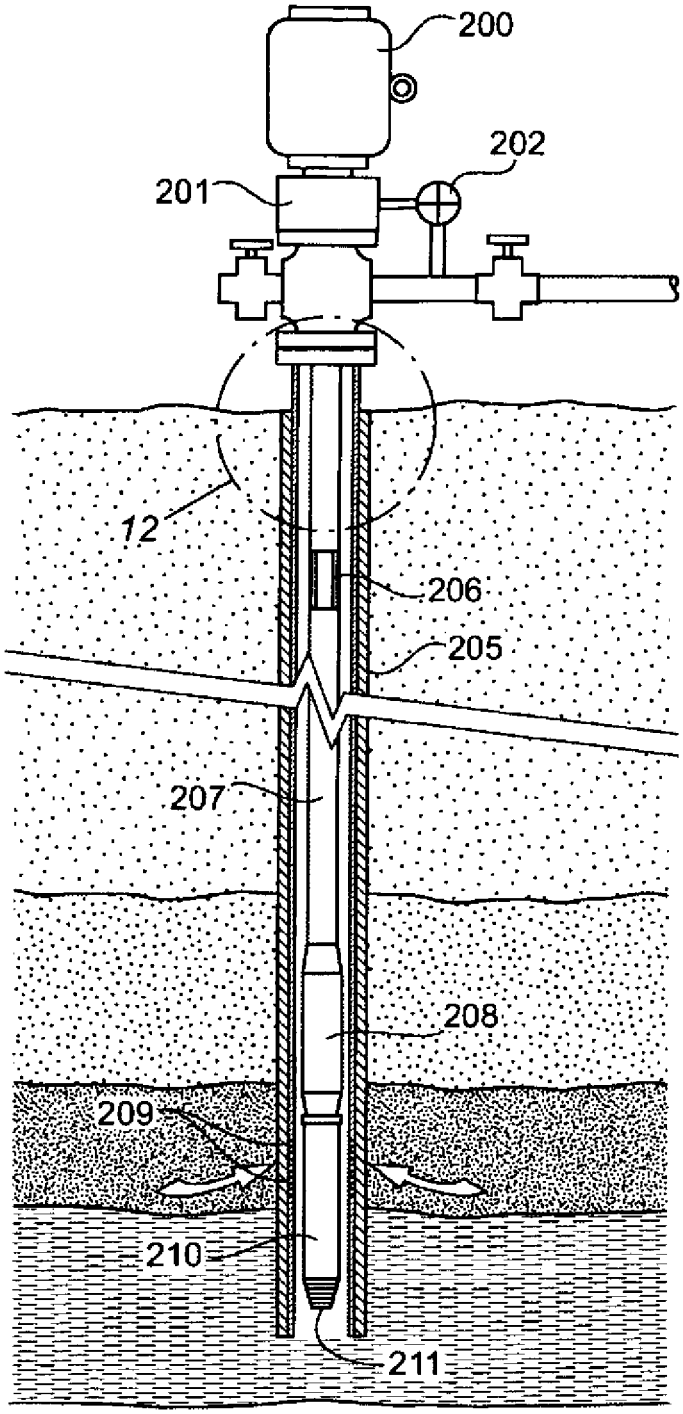

Embodiments of the present invention facilitate easier installation of a well pump. FIG. 13 shows an example method for installing a direct drive pump, the direct drive pump having a drive tube and a drive rod such as the embodiments illustrated in FIGS. 2 and 7. Generally, in an oilfield operation, a pump assembly is installed in a well using a well service rig. The well service rig has a derrick, draw works, and accessory equipment that allows the running in and pulling out of tubulars and other equipment for use in a well. The bottom hole assembly, including a multi-stage pump, thrust bearing, and drive rod and drive tube receiver, is attached via a connection, e.g., a threaded connection, to a length of production tubing 1301. The length of production tubing typically includes two joints of tubing, each 30 feet in length, and connected together via, e.g., a threaded connection, thus forming a stand of tubing that is about 60 feet long. The pump assembly and single stand of tubing are lowered into the well 1302 via the well service rig for about 60 feet, and the tubing is secured in the wellhead 1303. Another 60 foot stand of tubing is attached 1304, via, e.g., a threaded connection, to the stand that is secured in the wellhead and which is attached to the bottom hole assembly. The entire assembly is lowered 1305 a further 60 feet and another stand is attached to the production tubing. This process is continued until the bottom hole assembly is located at the desired depth in the well 1306, and the production tubing is secured in the well head. Next, the drive tube, which consists of 60 foot stands (two 30 foot joints joined via a threaded connection) of smaller diameter tubing is inserted into the production tubing 1307, and run to bottom in a similar fashion as the production tubing and bottom hole assembly was run and secured in the wellhead 1308. The drive string tube is equipped with centralizers to locate it concentrically inside the production tubing See, e.g., FIGS. 2, 3. The drive string is also equipped with a close fitting male stab-in member at the bottom, which fits into the drive tube seal bore receiver in the bottom hole assembly. This seal bore assembly locates the drive tube so that it is centered around the drive rod receiver within the bottom hole assembly (see, e.g., FIG. 10), while also allowing relative vertical movement between the drive tube and bottom hole assembly. The drive rods with stabilizers, in 50 to 75 foot stands, are then run inside of the drive tube, in a manner similar to how the drive tube was run 1309. The drive rods are typically 25 feet or 30 feet in length, and are attached to one another via threaded connections. The drive rod string is run to bottom and the splined rod connector is stabbed into the drive rod stab-in receiver in the bottom hole assembly. See, e.g., FIG. 10. This splined connection allows the rod to rotationally drive the centrifugal pump but provide for relative vertical movement between the drive rods and the bottom hole assembly. The direct drive pump which does not use a drive tube is installed in the same manner. The difference being that no drive tube is installed in the direct drive pump. Instead, the drive rod string is run directly after the bottom hole assembly and production tubing string are run to the proper depth and secured in the well head. The drive head is then installed such that the drive rod can be turned by the electric motor (see, e.g., FIG. 2), thus driving the multi-stage centrifugal pump in the bottom hole assembly 1310. The surface flow line is attached to the well head 1311 and the pump is ready for operation. The surface flow line can then be used to transport well fluids lifted by the pump to any desired location, e.g., nearby storage container, etc.

It should be understood that there exist implementations of other variations and modifications of the invention and its various aspects, as may be readily apparent to those of ordinary skill in the art, and that the invention is not limited by specific embodiments described herein. Features and embodiments described above may be combined with and without each other. It is therefore contemplated to cover any and all modifications, variations, combinations or equivalents that fall within the scope of the basic underlying principals disclosed and claimed herein.

What is claimed is:

1. A direct drive pump system, comprising:

a well casing, the well casing being a housing for the direct drive pump system;

a pump having a pump inlet situated at a lower end of the well casing;

a production tubing;

a drive string rod, the drive string rod being situated within the production tubing;

at least one of a stabilizer and a bearing, the at least one of a stabilizer and a bearing being disposed on the drive string rod and serving as support for the drive string rod to ensure stable rotation during operation of the pump;

a drive tube, the drive tube being situated within the production tubing; and at least one centralizer, wherein the at least one centralizer is associated with the drive tube and supports the drive tube so that the drive tube remains fairly centered in the production tubing, and the drive string rod and its stabilizers are situated within the drive tube, wherein the pump situated downhole in the well casing drives the drive string rod to rotate to encourage well fluid pressurized from the pump to flow uphole towards the surface for production.

2. The pump system of claim 1, wherein the at least one of a stabilizer and a bearing is closely spaced along the entire length of the drive string rod to ensure stable rotation during operation of the drive string rod.

3. The pump system of claim 2, wherein the at least one of a stabilizer and a bearing is at least one of a bearing assembly, a bushing, a bearing mounted in a housing, a bearing mounted in a plastic housing, a ceramic-polymer alloy bearing, a ceramic bushing, a non-corrosive bearing, and a ceramic bearing.

4. The pump system of claim 2, wherein the fluid flow passes around an outer surface of the production tubing.

5. The pump system of claim 2, wherein the fluid flow passes around an outer surface of a drive tube.

6. The pump system of claim 1, further comprising a pressure regulator situated between a well pump and a production flow line, wherein the pressure regulator opens when the pressure differential between the drive tube and the production tubing exceeds a predetermined set value.

7. The pump system of claim 1, further comprising a motor to drive the pump in order to drive the drive string rod, wherein the motor is an electric motor which effectively drives the rod string at one of: a low RPM with speed increasing capability gearing, and about 3500 RPM pump operational speed.

8. The pump system of claim 1, wherein the pump provides a high volume artificial lift system of well fluid.

9. A method for installing a direct drive pump in a well, comprising:

coupling a bottom hole assembly to a first length of production tubing;

lowering the bottom hole assembly and the first length of production tubing into a well;

securing the production tubing in a wellhead;

coupling an additional length of production tubing to the first length of production tubing;

lowering the additional length of production tubing into the well;

lowering a first length of drive tube down inside the production tubing lengths;

securing the first length of drive tube to the wellhead;

coupling an additional length of drive tube to the first length of drive tube;

lowering the additional length of drive tube inside the production tubing lengths;

lowering a first length of at least one drive rod down inside the drive tube, the at least one drive rod having at least one stabilizer for supporting the drive rod in the respective length of drive tube;

coupling an additional length of at least one drive rod to the first length of at least one drive rod;

lowering the additional length of at least one drive rod down inside the drive tube; and attaching a drive head to the production tubing, drive tube, and drive rods such that the lengths of drive rods can be turned by a motor to drive the pump in the bottom hole assembly, wherein the length of drive rod includes a splined rod connector on one end and a stab-in receiver on the other end, so that when the splined rod connector of the first length of drive rod meets the stab-in receiver of the additional length of drive rod.

10. The method of claim 9, wherein more lengths of production tubing are attached in succession to the additional length of production tubing until a desired depth by the bottom hole assembly is reached in the well and the lengths of production tubing are secured to the wellhead, more lengths of drive tube are attached in succession to the additional length of drive tube until a desired depth is reached in the well and the lengths of the drive tube are secured to the wellhead, and more lengths of at least one drive rod are attached in succession to the additional length of at least one drive rod until a desired depth is reached in the well, and the lengths of the at least one drive rod are supported by stabilizers in the drive tube.

11. The method of claim 10, wherein the bottom hole assembly includes a multi-stage pump, a thrust bearing, a drive rod, and a drive tube receiver.

12. The method of claim 11, wherein at least one of at least two lengths of the drive tube, at least two lengths of production tubing, and at least two lengths of drive rods are mated by a threaded connection.

13. The method of claim 12, wherein each respective length is two 30 feet segments, the two segments being coupled together and lowered into the well as a single length.

14. The method of claim 9, wherein a surface flow line is attached to the wellhead.

15. A method for installing a direct drive pump in a well, comprising:

coupling a bottom hole assembly to a first length of production tubing;

lowering the bottom hole assembly and the first length of production tubing into a well;

securing the production tubing in a wellhead;

coupling an additional length of production tubing to the first length of production tubing;

lowering the additional length of production tubing into the well;

lowering a first length of at least one drive rod down inside the production tubing, the at least one drive rod having at least one stabilizer for supporting the drive rod in the respective length of production tubing;

coupling an additional length of at least one drive rod to the first length of at least one drive rod;

lowering the additional length of at least one drive rod down inside the production tubing; and attaching a drive head to the production tubing and drive rods such that the lengths of drive rods can be turned by a motor to drive the pump in the bottom hole assembly, wherein the direct drive pump includes a well housing, a pump having a pump inlet situated at a lower end of the well casing, the production tubing, the at least one drive rod, the at least one drive rod being situated within the production tubing, the at least one stabilizer, the at least one stabilizer being disposed on the at least one drive rod and serving as support for the drive rod to ensure stable rotation during operation of the pump, a drive tube, the drive tube being situated within the production tubing; and at least one centralizer, wherein the at least one centralizer is associated with the drive tube and supports the drive tube so that the drive tube remains fairly centered in the production tubing, and the at least one drive rod and its respective stabilizers are situated within the drive tube, wherein the pump situated downhole in the well casing drives the drive rod to rotate to encourage well fluid pressurized from the pump to flow uphole towards the surface for production.

* * * * *

UNITED STATES PATENT AND TRADEMARK OFFICE

CERTIFICATE OF CORRECTION

PATENT NO. : 8,336,632 B2
APPLICATION NO. : 12/552806
DATED : December 25, 2012
INVENTOR(S) : William Bruce Morrow and Raymond Witten It is certified that error appears in the above-identified patent and that said Letters Patent is hereby corrected as shown below:

Title page should be deleted and substitute therefor the attached title page.

In the drawings, Sheet 2, Fig. 2, should be replaced by submitted drawing Figure 2.

In the drawings, Sheet 4, Figs. 5A, B, and C, 6A, B, and C, and 7A, B, and C should be replaced by submitted
Figures 5A, 5B, 5C,
Figures 6A, 6B, 6C,
Figures 7A, 7B, 7C.

In the drawings, Sheet 5, Figs. 8A, B and C and 9A, B, and C, should be replaced by submitted
Figures 8A, 8B, 8C,
Figures 9A, 9B, 9C.

In the drawings, Sheet 6-9, Figs. 10 and 11, should be replaced by submitted drawing Figure 10 and Figure 11.

In the drawings, Sheet 10, Fig. 12, should be replaced by submitted drawing Figure 12.

Signed and Sealed this
Twenty-fourth Day of September, 2013

Teresa Stanek Rea

Teresa Stanek Rea
*Deputy Director of the United States Patent and Trademark Office*

(12) United States Patent
Morrow et al.

(10) Patent No.: US 8,336,632 B2
(45) Date of Patent: Dec. 25, 2012

(54) SYSTEM AND METHOD FOR DIRECT DRIVE PUMP

(75) Inventors: William Bruce Morrow, Santa Barbara, CA (US); Raymond Witten, Owasso, OK (US)

(73) Assignee: Harrier Technologies, Inc., Greenwich, CT (US)

( * ) Notice: Subject to any disclaimer, the term of this patent is extended or adjusted under 35 U.S.C. 154(b) by 168 days.

(21) Appl. No.: 12/552,806

(22) Filed: Sep. 2, 2009

(65) Prior Publication Data

US 2011/0048738 A1 Mar. 3, 2011

(51) Int. Cl.
*E21B 19/16* (2006.01)
*E21B 43/00* (2006.01)

(52) U.S. Cl. ..... 166/380; 166/105; 417/360; 417/423.3

(58) Field of Classification Search ..... 166/380, 166/382, 68, 105; 417/360, 423.3, 424.1
See application file for complete search history.

(56) References Cited

U.S. PATENT DOCUMENTS

| | | | | |
|---|---|---|---|---|
| 2,171,171 | A * | 8/1939 | Brauer | 166/68 |
| 4,957,161 | A * | 9/1990 | Cholet et al. | 166/105 |
| 5,069,284 | A | 12/1991 | Gray | |
| 5,309,998 | A | 5/1994 | Rivas et al. | |
| 5,960,886 | A | 10/1999 | Morrow | |
| 6,413,065 | B1 | 7/2002 | Dass | |
| 6,454,010 | B1 | 9/2002 | Thomas et al. | |
| 6,523,624 | B1 | 2/2003 | Cousins et al. | |
| 6,729,391 | B2 * | 5/2004 | Hill et al. | 166/68.5 |
| 6,796,390 | B1 | 9/2004 | Bakker | |
| 6,966,366 | B2 | 11/2005 | Rogers, Jr. | |
| 2006/0000605 | A1 * | 1/2006 | Jordan et al. | 166/255.1 |
| 2010/0166578 | A1 * | 7/2010 | Watson | 417/423.3 |

OTHER PUBLICATIONS

PCT International Search Report for PCT/US2010/045377, dated Oct. 8, 2010.

* cited by examiner

*Primary Examiner* Daniel P Stephenson
(74) *Attorney, Agent, or Firm* Kenyon & Kenyon LLP

(57) ABSTRACT

A method and a system are provided for a direct drive pump for use in pumping fluids and/or quasi-fluids from one location to another. In the direct drive pump, bearings or bushings are optimally spaced, taking into account various operational considerations such as load, path, pressure, and tension. Further, bearings or bushings are coupled to the drive string, thus assisting in more efficient installation and de-installation. The bearings or bushings are not fixed to the production casing or drive tube. In embodiments, the drive tube can be vented, and the production fluid can be used as a lubricant for the system bearings.

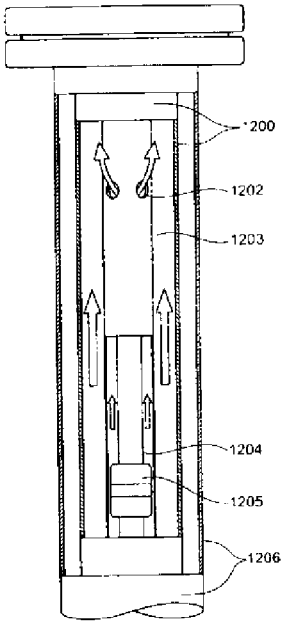

15 Claims, 11 Drawing Sheets